US012485337B1

(12) United States Patent
Flores

(10) Patent No.: US 12,485,337 B1
(45) Date of Patent: Dec. 2, 2025

(54) DUAL HINGE FIELDING GLOVE WITH MID-KNUCKLE LOOP

(71) Applicant: Christian Flores, Richmond, TX (US)

(72) Inventor: Christian Flores, Richmond, TX (US)

( * ) Notice: Subject to any disclaimer, the term of this patent is extended or adjusted under 35 U.S.C. 154(b) by 17 days.

(21) Appl. No.: 19/052,434

(22) Filed: Feb. 13, 2025

(51) Int. Cl.
*A63B 71/14* (2006.01)

(52) U.S. Cl.
CPC ..... *A63B 71/143* (2013.01)

(58) Field of Classification Search
CPC ..... A63B 71/143; A41D 19/001
USPC ..... 2/19, 161.1
See application file for complete search history.

(56) References Cited

U.S. PATENT DOCUMENTS 3,300,787 A * 1/1967 Denkert ..... A63B 71/143 2/19
RE28,036 E * 6/1974 Rosenbaum ..... A63B 71/143 2/19
3,994,024 A * 11/1976 Bates ..... A63B 71/143 2/19
4,847,915 A 7/1989 Keene
5,253,365 A * 10/1993 Clevenhagen ..... A63B 71/143 D29/115
6,536,046 B1 3/2003 Gilligan
6,810,531 B1 * 11/2004 Lento ..... A41D 19/0037 2/161.1
9,662,561 B1 * 5/2017 Valenti ..... A63B 71/143
2006/0137067 A1 * 6/2006 Wu ..... A41D 19/015 2/19

FOREIGN PATENT DOCUMENTS

WO WO-2018051421 A1 * 3/2018 ..... A63B 71/143

* cited by examiner

*Primary Examiner* — Tajash D Patel

(57) ABSTRACT

The invention is a fielding glove designed to improve control, comfort, and fit by addressing issues with tradition gloves that can shift or require excessive wrist tightening. Key features include a dual hinge closure for enhanced grip and ball handling, a mid-knuckle loop that secures the fingers, and a shortened, separated thumb panel that allows natural hand movement. The ergonomic design of this fielding glove minimizes discomfort in wrist movement while offering a flexible grip that enhances a player's control and precision in handling the ball.

9 Claims, 9 Drawing Sheets

DUAL HINGE FIELDING GLOVE WITH MID-KNUCKLE LOOP

FIELD

The present technology pertains to a fielding glove and more specifically, the addition of a dual hinge closure, an adjustable mid-knuckle loop, and a shortened and separated thumb panel that allows for superior control and fluid movement of the fielding glove.

BACKGROUND

Traditional fielding gloves (e.g., baseball, softball, etc.) are not firmly secured to a player's hand and can shift during play. This requires players to wear batting gloves or tighten their wrist straps excessively, which can restrict hand movement. Traditional baseball gloves also restrict the player's ability to fully close their fingertips to their palms, which can affect grip and ball handling.

A fielding glove with features that firmly secure the player's hand without restricting the player's use of the fielding glove is needed. The dual hinge fielding glove solves such issues by incorporating a more ergonomic glove shape using a dual-hinge closure and a shortened and separate thumb panel, while also providing seamless finger security with a mid-knuckle loop. These features eliminate the need for constant wrist tightening and enhances control over the ball with a more comfortable grip.

SUMMARY OF THE INVENTION

The invention is an improved fielding glove designed to secure a player's hand without the need for excessive wrist tightening. It incorporates a dual-hinge mechanism for a more a more secure grip, a shortened and separate thumb panel, and a mid-knuckle loop for secure finger placement. The dual hinge close is achieved through a half-circle palm lace run that allows the glove to have two hinge points for closure: one at the Metacarpophalangeal (MCP) joint for the thumb and another at the Proximal Interphalangeal (PIP) joint for the fingers. In comparison, a traditional glove only has a single hinge at the MCP joint. These design enhancements ensure a more secure and comfortable fit, allowing players to close their hands more naturally for improved grip and ball handling without restricting movement.

The invention includes a glove. The glove can include an inner shell with a plurality of fingers. The glove can also include an outer shell with a plurality of fingers, the outer shell coupled to the inner shell and the respective plurality of fingers. The glove can also include a handstall with a plurality of fingers coupled to an inside of the outer shell and inner shell.

The glove can also include webbing connecting a thumb and first finger of the respective plurality of fingers. The glove can also include a mid-knuckle loop, which is securely attached to the handstall and configure to secure one or more fingers of a user of the handstall. The glove can also include a half-circle palm lace run configured with two hinge points for closing the glove.

The glove can also include one of the two hinge points is at a Metacarpophalangeal (MCP) joint of the user's thumb and a second of the two hinge points is at the Proximal Interphalangeal (PIP) joint for the fingers. The glove can be constructed of leather and/or synthetic materials. The glove can include a handstall that is designed to accommodate the user's fingers, while also serving as an origin point for a thumb loop and a pinky loop. The glove can have felt material sewn onto the handstall and inserted between the inner and outer shells. The glove's handstall can be separated into two portions by the half-circle palm lace run, wherein one of the portions is the thumb. The glove can have a half-reversed heel lace run that also runs through a heel pad. The glove can have a heel lace that is reverse-laced on a thumb side. The glove can include gap welting and a strategic lace pattern at the base of the webbing.

BRIEF DESCRIPTION OF DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

The present invention will be further understood and appreciated from the following detailed description taken in conjunction with the drawings which.

DETAILED DESCRIPTION

The invention detailed here is specifically for use as a fielding glove in baseball. The traditional baseball fielding glove assists players in catching and fielding the ball by providing hand protection for impact and webbing to trap the ball. These operations may be enhanced by incorporating adjustments for a more ergonomic and secure grip.

Figure 1:
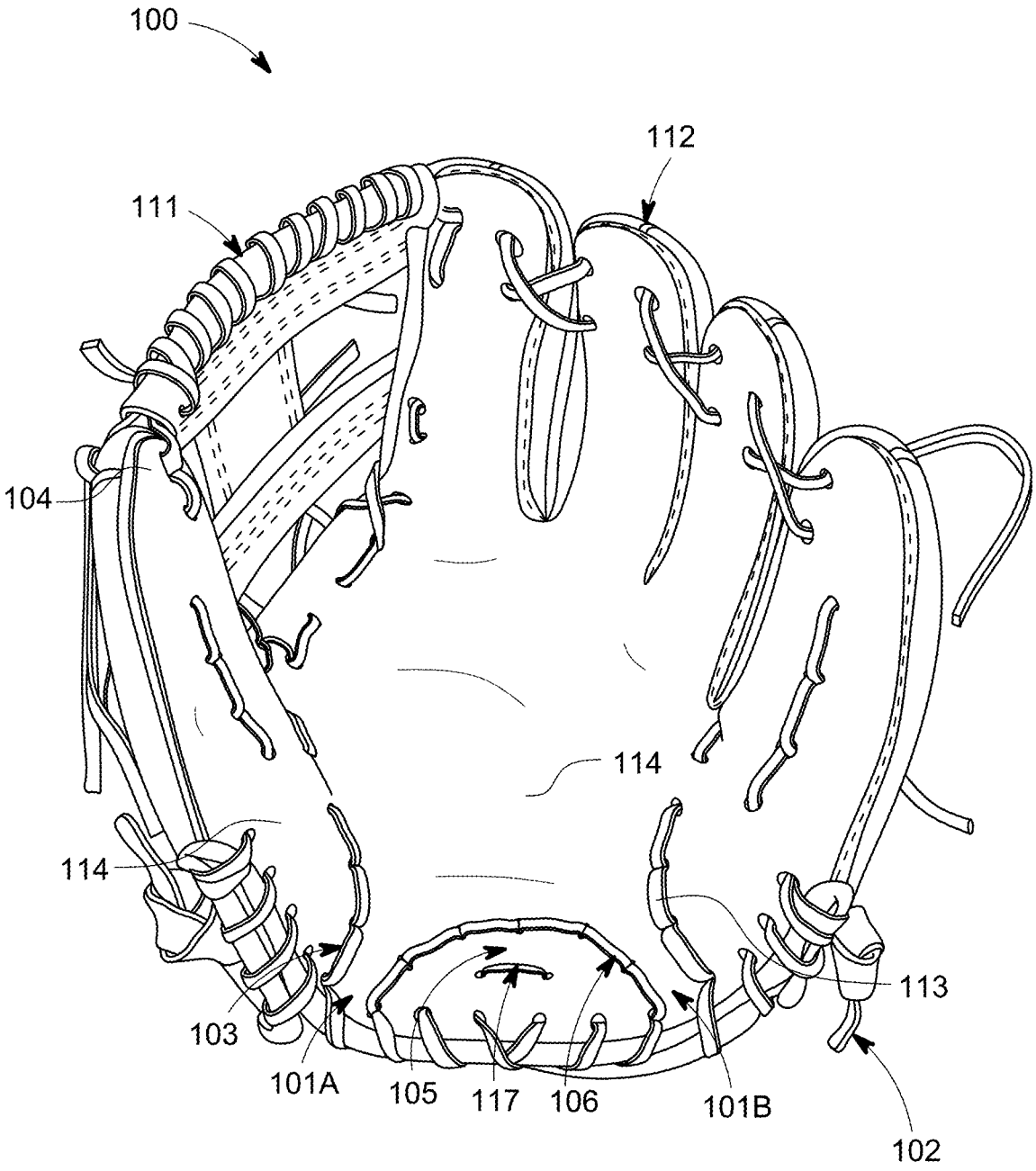
FIG. 1 illustrates palm side up view of an example fielding glove not in use.

FIG. 1 illustrates fielding glove 100 with a dual-hinge and mid-knuckle adjustable strap 102. Fielding glove 100 includes fingers 112, web 111, thumb 104, palm 114, palm lace 106, finger side heel lace 113, thumb side heel lace 103, heel lace 117, and heel pad 105. Fielding glove 100 also includes a first hinge 101A and second hinge 101B. The hinges are created by stitching in fielding glove 100. For example, the first hinge is created by palm lacing 106 and thumb side heel lace 103, and the second hinge is created by palm lace 106 and finger side heel lace 113. The dual hinge close is achieved through a half-circle palm lace run that allows the glove to have two hinge points for closure: one at the Metacarpophalangeal (MCP) joint for the thumb and another at the Proximal Interphalangeal (PIP) joint for the fingers. In comparison, a traditional glove only has a single hinge at the MCP joint. The dual hinge allows the thumb and finger sides of the glove to work independently of each other, providing greater flexibility and control. Fielding glove 100 also includes heel pad 105. Heel pad 105 is created within palm lace 106. Heel lace 117 secures the heel pad 105 in place. Thumb side heel lace 103 creates the first hinge 101A, along with thumb panel 104. Thumb panel 104 is connected to the fingers 112 via the web 111. Thumb panel 104 is shortened and separated from heel pad 105 via thumb side heel lace 103. Fielding glove 100 also included mid-knuckle adjustable strap 102. Mid-knuckle adjustable strap 102 loosens and tightens the mid-knuckle loop shown in FIGS. 4 and 5.

Figure 2:
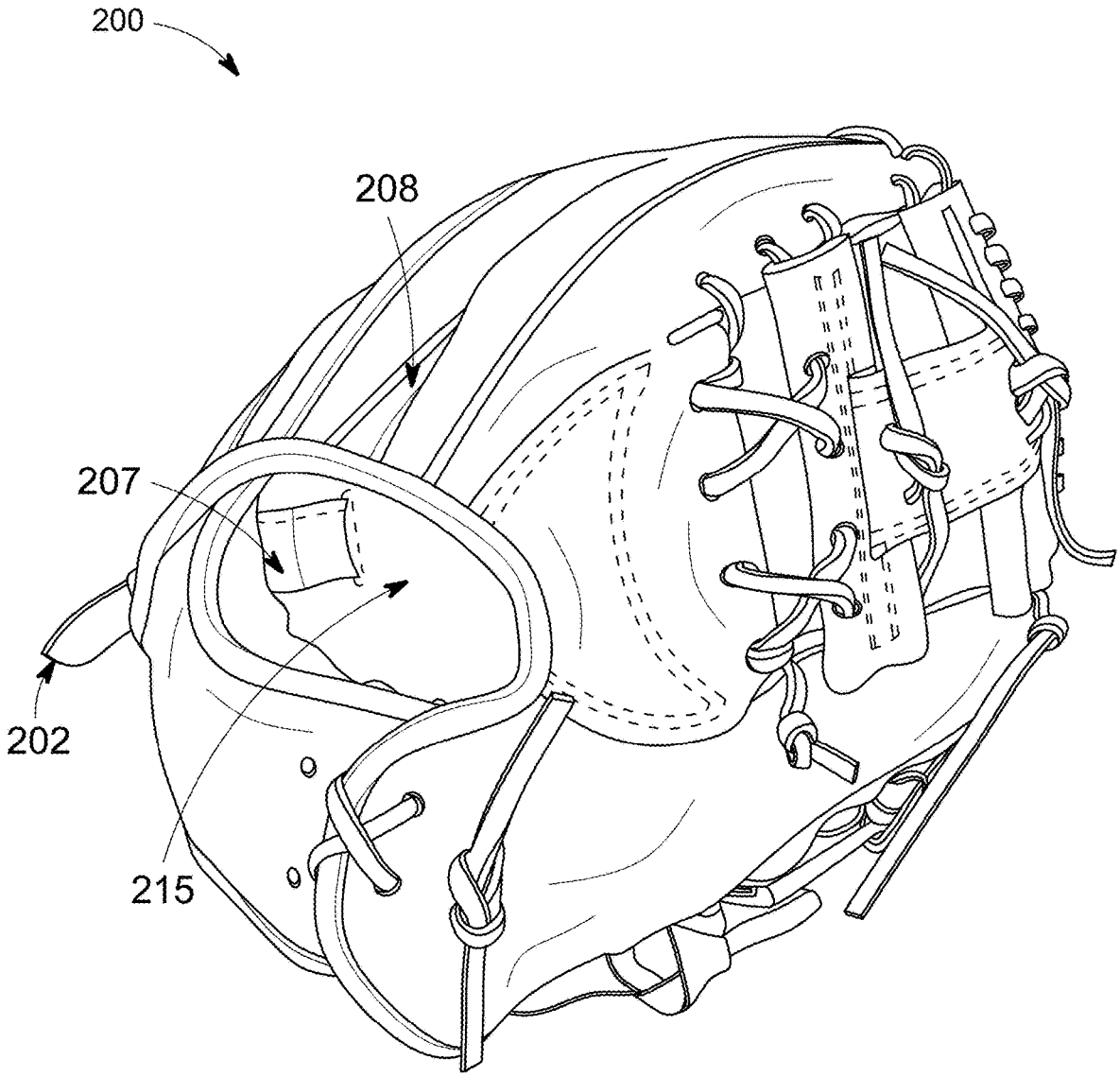
FIG. 2 illustrates a dorsal side view of an example fielding glove not in use, showing a view of the mid-knuckle loop.

FIG. 2 illustrates a dorsal view of the fielding glove 100. Fielding glove 200 includes mid-knuckle loop 207, mid-knuckle adjustable strap 202, handstall 215, and a gap welt 208. Mid-knuckle loop 207 is securely attached to the inside of handstall 215, positioned between the openings for the ring and middle fingers. Precisely designed cutouts enable mid knuckle loop 207 to slide freely. The gap welt 208 is positioned between the forefinger and the middle finger. Gap welting 208 and a strategic lace pattern at the base of the webs provides a deeper and wider catching surface. Gap welt 208 extends the palm leather between the index and middle fingers.

Figure 3:
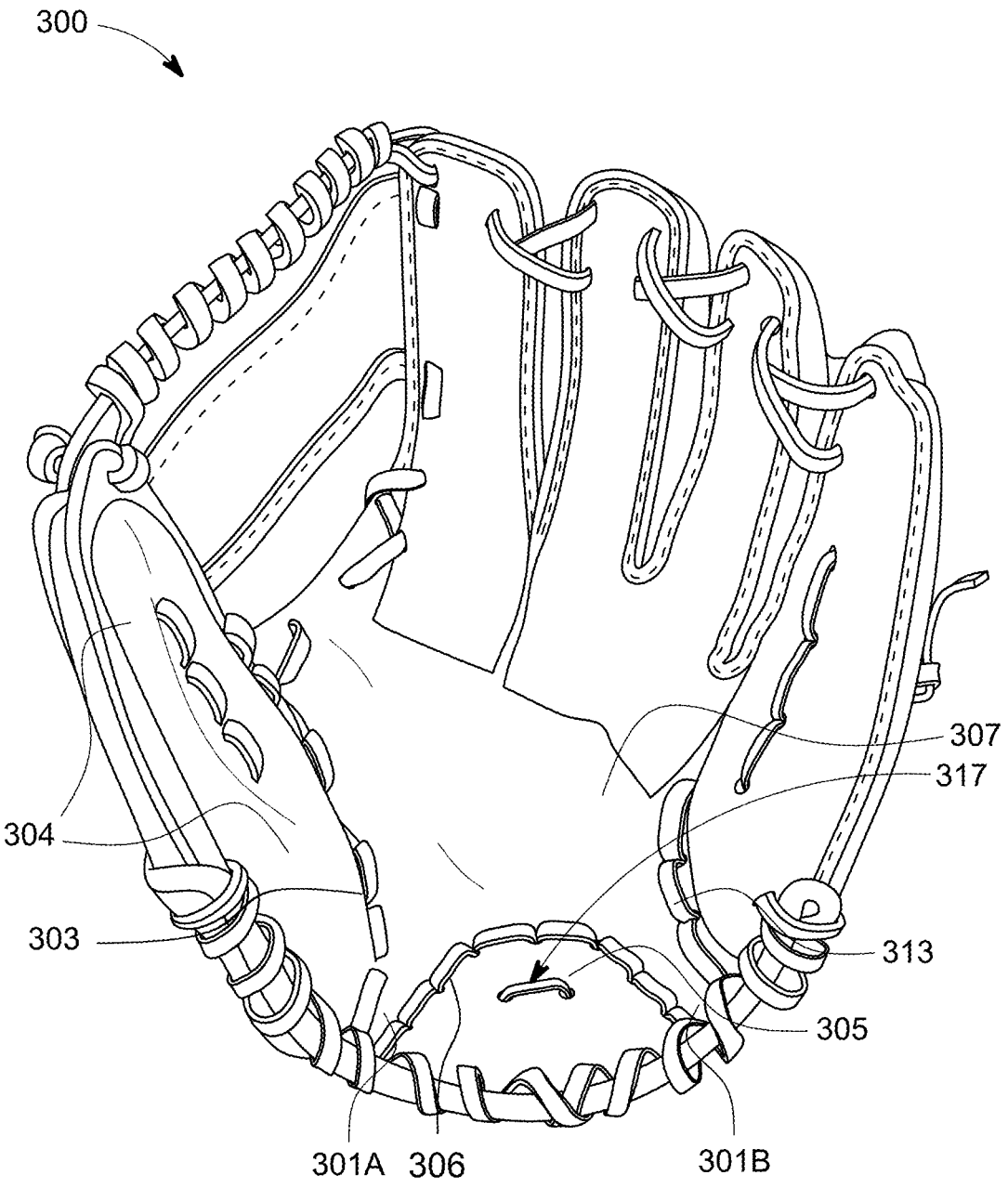
FIG. 3 illustrates palm side up view of a transparent fielding glove not in use.

FIG. 3 illustrates a transparent view of a palm side up example fielding glove. Fielding glove 300 includes mid-knuckle loop 307, heel pad 305 finger side heel lace 313, heel lace 317, thumb side heel lace 303, and thumb panel 304. Mid-knuckle loop 307 is visible and positioned above the heel pad 305. Hinges are positioned on either side of heel pad 305. Hinge 301A is created by palm lace 306 and thumb side heel lace 303. Hinge 301B is created by finger side heel lace 313 and palm lace 306. Thumb panel 304 is adjacent to hinge 301A and held in place by the thumb side heel lace 303.

Figure 4:
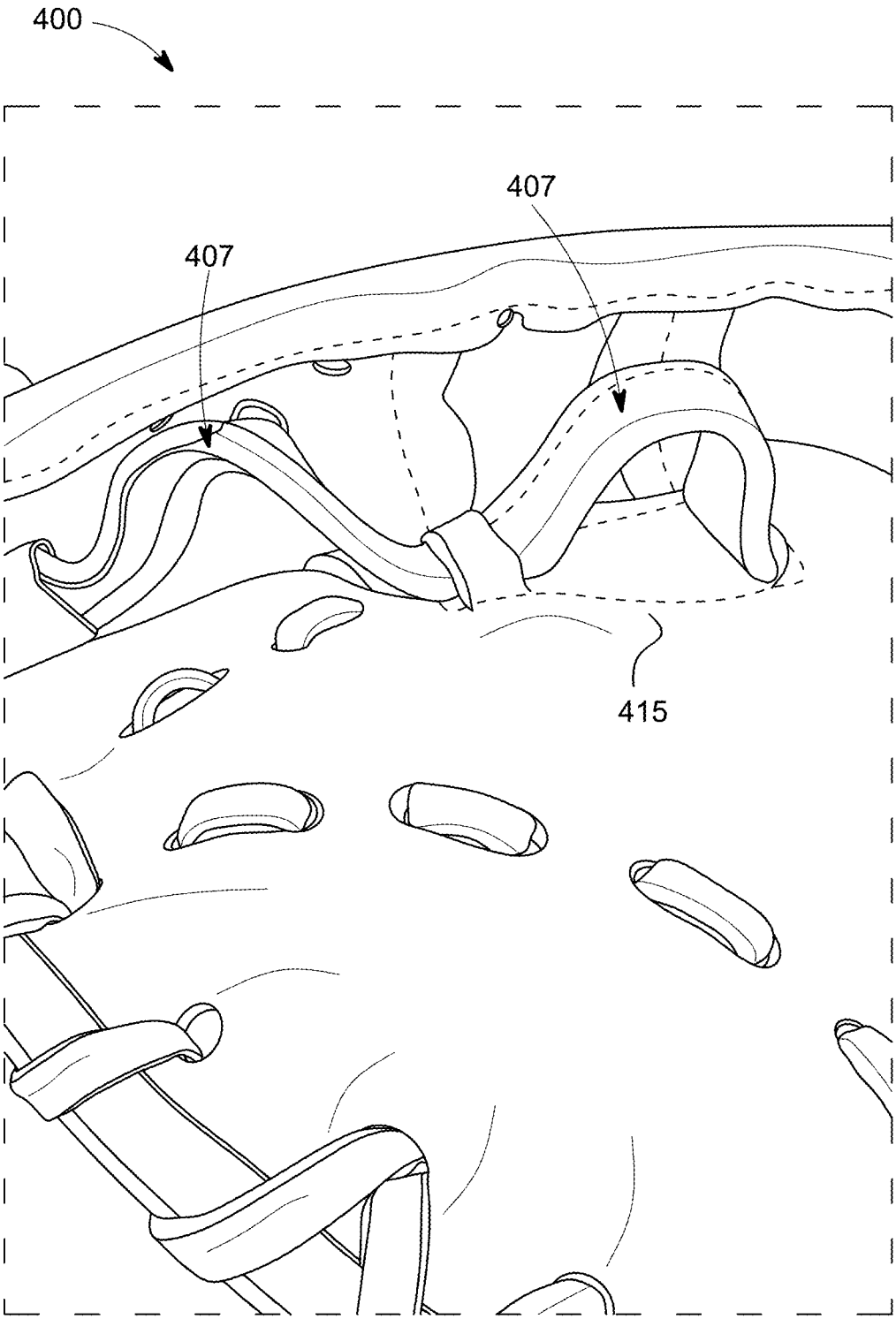
FIG. 4 illustrates a close-up view of a loosened mid-knuckle loop and the back side of the heel pad.
Figure 5:
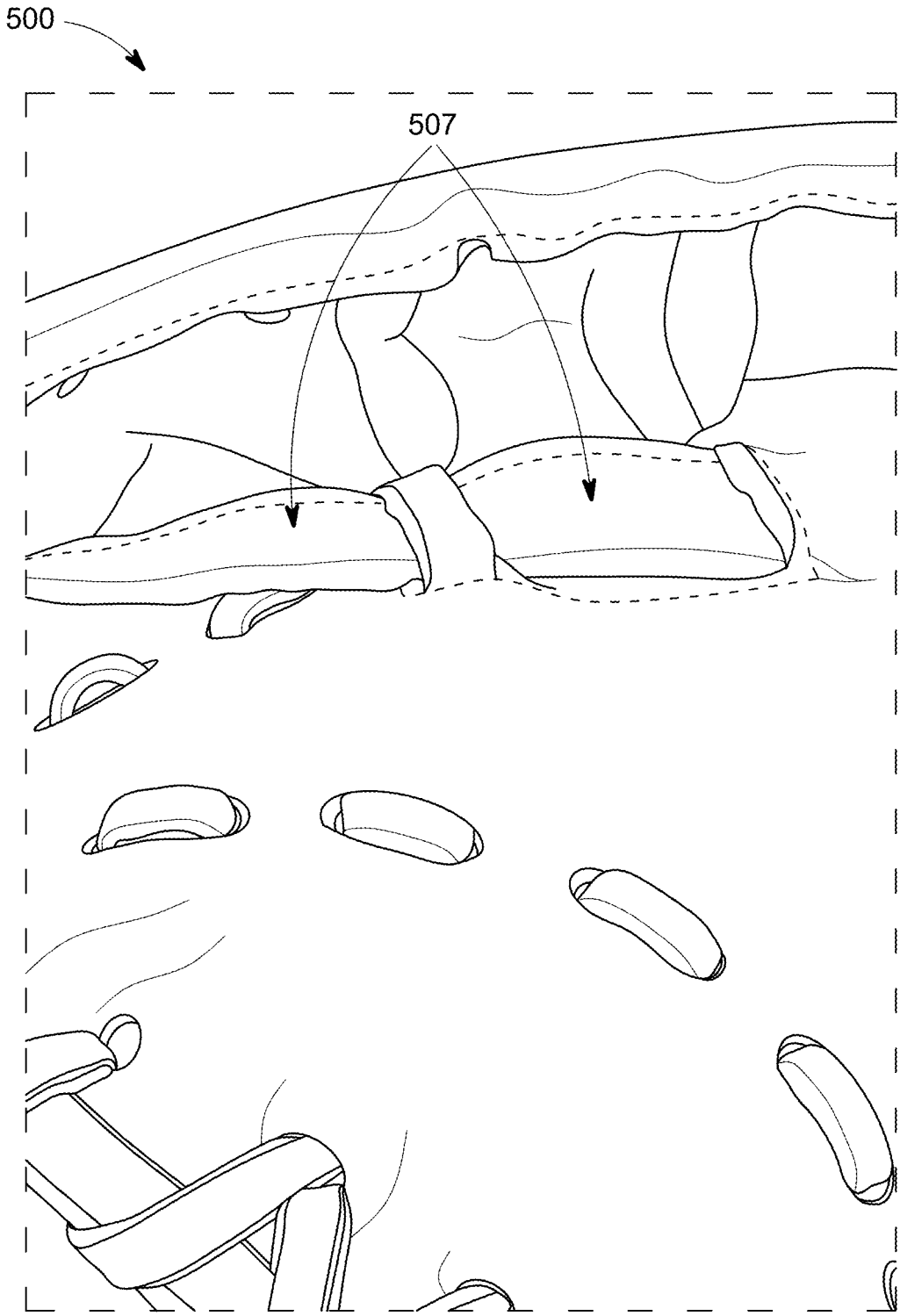
FIG. 5 illustrates a close-up view of a tightened mid-knuckle loop and the back side of the heel pad.
Figure 6:
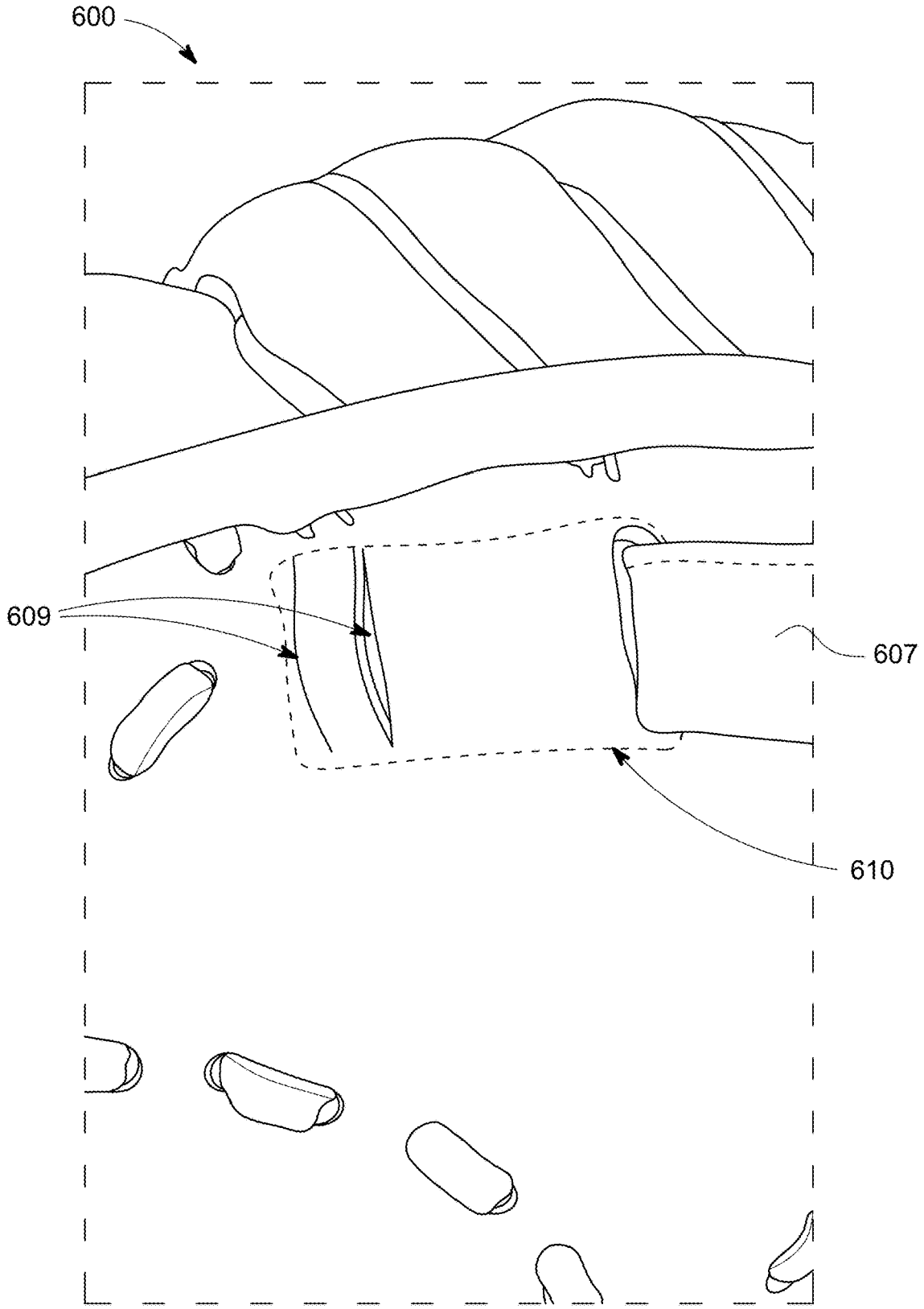
FIG. 6 illustrates a close-up view of the cutouts and sewn-in reinforcements for the mid-knuckle loop.

FIGS. 4-6 illustrate multiple views of the mid-knuckle loop 407, 507. FIG. 4 displays a loosened mid-knuckle loop 407 not in use. Utilizing an adjustable mid-knuckle loop 407 in place of a traditional pinky loop allows the hand to be securely anchored to the handstall 415 of the glove. By tightening this loop, it effectively envelops the middle finger and simultaneously cinches the ring and pinky fingers, ensuring a more secure and ergonomic fit. The mid-knuckle loop eliminates the need for excessive wrist tightening, which can restrict movement and cause discomfort. By securing directly to the fingers, the glove provides a snug fit and enhances control over the ball. FIG. 5 displays a tightened mid-knuckle loop 507 not in use. Precisely designed cutouts enable the mid knuckle loop 407/507 to slide freely, as shown loosened and tightened in FIGS. 4 and 5. FIG. 6 displays the cutouts 609 and the sewn-in reinforcements 610 that secure the mid-knuckle loop 607. Mid-knuckle loop 607 is removed to show the cutouts 609, and sewn in-reinforcements 610 that hold the mid-knuckle loop 607 together.

Figure 7:
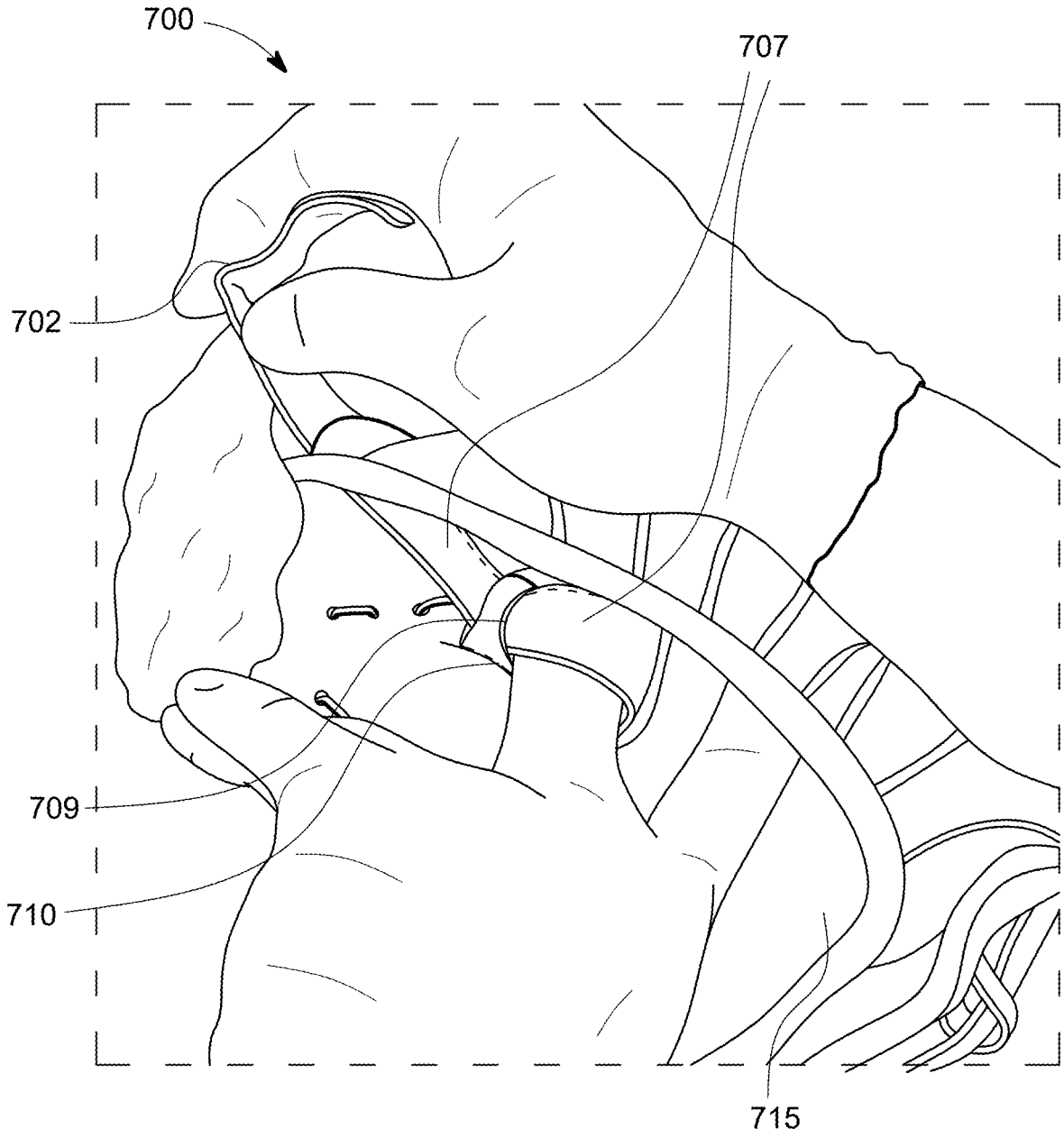
FIG. 7 illustrates a tightened mid-knuckle loop in use in the example fielding glove.

FIG. 7 illustrates the mid-knuckle loop 707 securing the middle finger of the user's hand. Fielding glove 700 includes mid-knuckle loop 707, mid-knuckle adjustable strap 702, and handstall 715. The user illustrates fielding glove 700 in use, with a pulled and tightened mid-knuckle loop 707. Mid-knuckle loop is secured by cutouts 709 and sewn-in reinforcements 710. The mid-knuckle loop adjustable strap 702 runs through sewn-in reinforcements 710 and cutouts 709, and pulled out of fielding glove 700.

Figure 8:
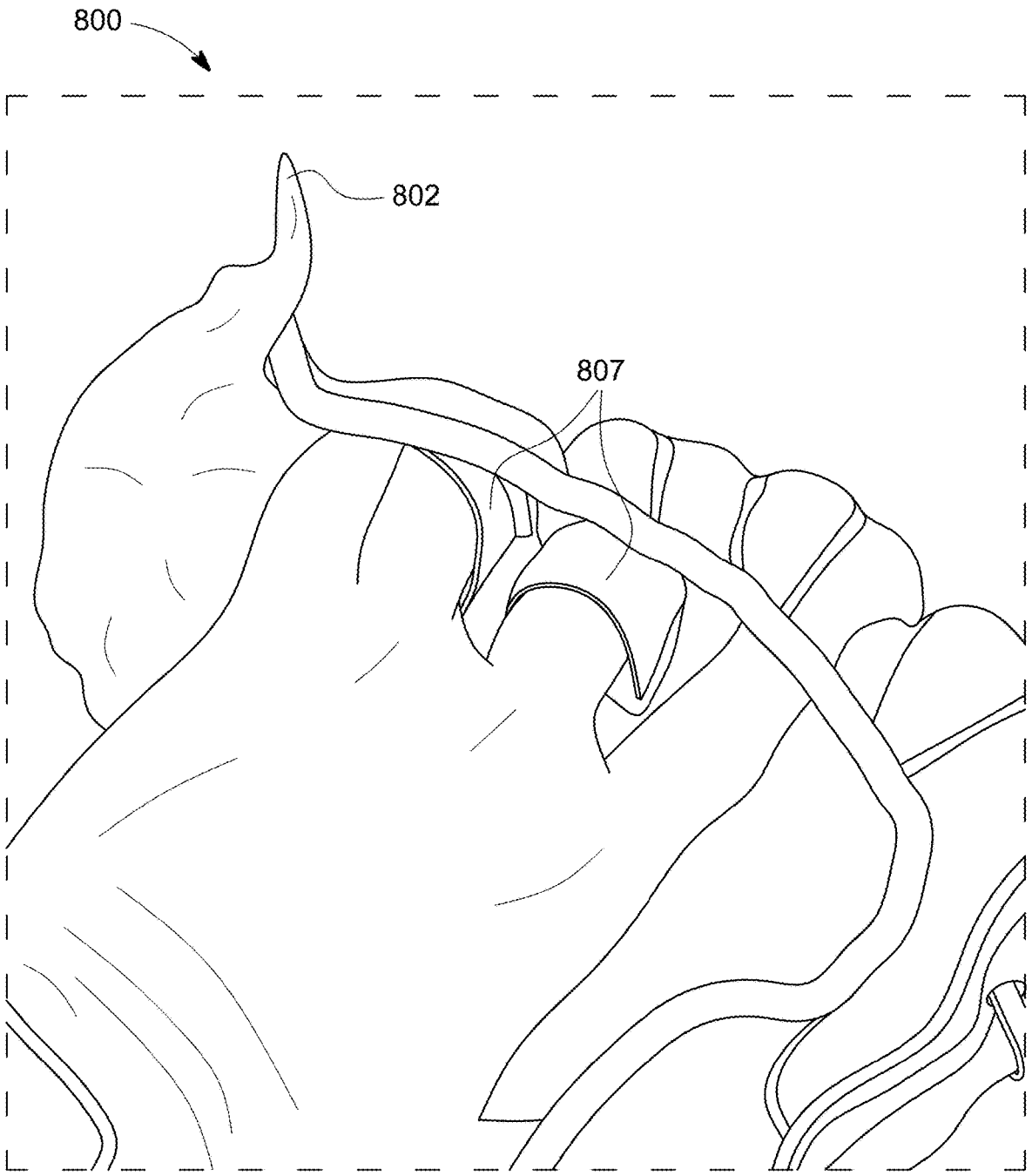
FIG. 8 illustrates a dorsal side view of the example fielding glove in use.

FIG. 8 illustrates the mid-knuckle loop 807 securing the middle finger of the user's hand. Fielding glove 800 includes a mid-knuckle loop 807, and mid-knuckle adjustable strap 802. The ring and pinky finger are positioned inside the handstall and under the mid-knuckle loop adjustable strap 802. Mid-knuckle loop 807 secures the middle finger only, positioned next to forefinger. In reference to the fingers of the glove, no player's finger is present in the pointer finger of the glove. The positioning of the fingers in the glove enable closure of the glove at the dual hinges, as disclosed.

Figure 9:
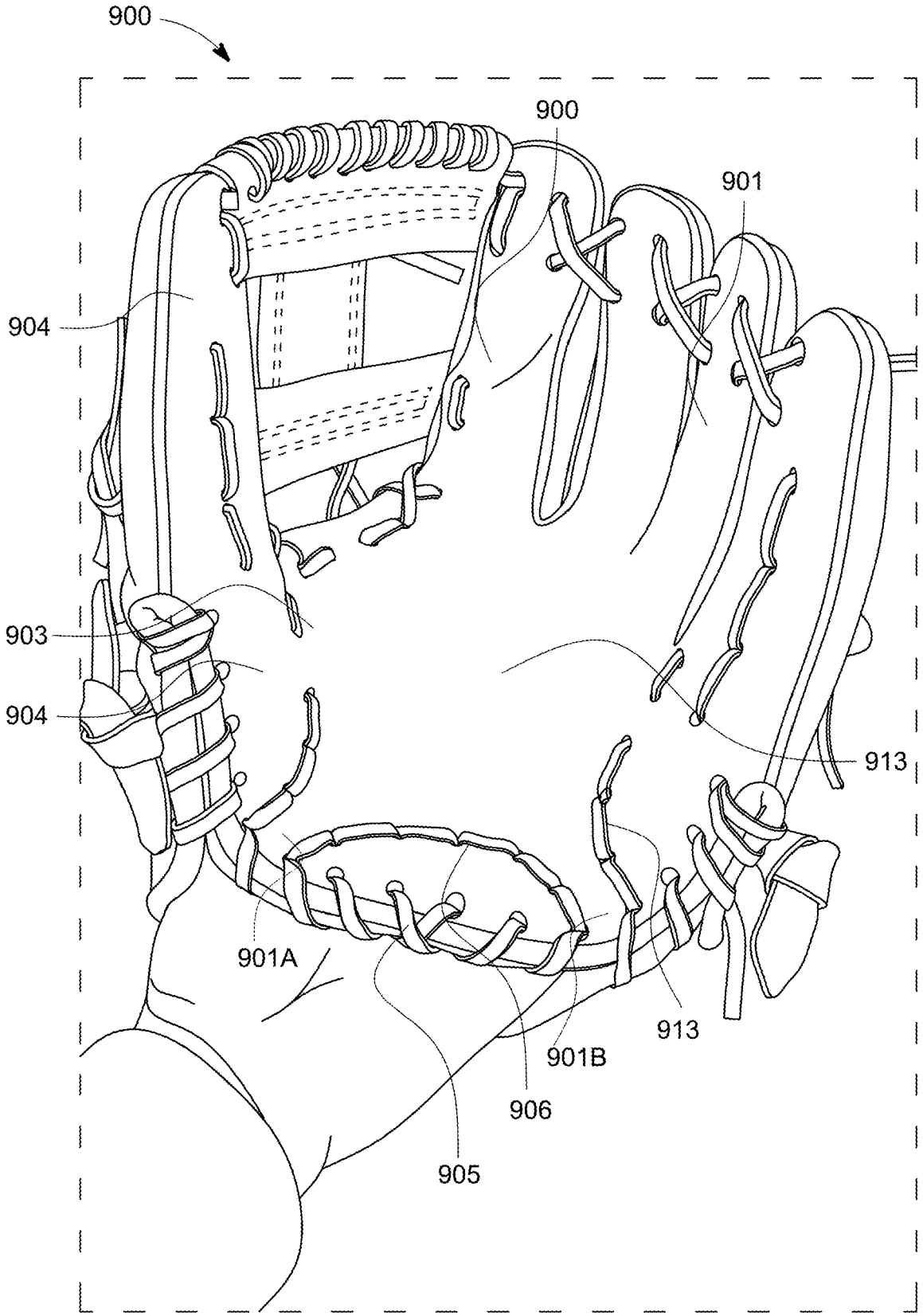
FIG. 9 illustrates a palm side up view detailing the dual hinge mechanism of the example fielding glove in use.

FIG. 9 illustrates the dual hinge mechanism made possible by hinge 901A and hinge 901B. Fielding glove 900 includes hinge 901A, hinge 901B, palm lace 906, heel pad 905, thumb panel 904, finger side heel lace 913, and thumb side heel lace 903. Lacing below heel pad 905 is reverse laced on the thumb side to allow for a deeper catching surface and ergonomic closure. Hinge 901A is adjacent to the thumb panel 904, and created by thumb side heel lace 903 and palm lace 906. Hinge 901B is created by palm lace 906 and finger side heel lace 913.

While the foregoing is directed to embodiments of the present invention, other and further embodiments of the invention may be devised without departing from the basic scope thereof and the scope thereof is determined by the claims that follow.

What is claimed is:

1. A glove comprising:

an inner shell with a plurality of fingers;

an outer shell with a plurality of fingers, the outer shell coupled to the inner shell and the respective plurality of fingers;

a handstall with a plurality of fingers coupled to an inside of the outer shell and an inside of the inner shell;

a webbing connecting a thumb and first finger of the respective plurality of fingers;

a mid-knuckle loop securely attached to the handstall through the outer shell and configured to secure one or more fingers of a user to the handstall through the outer shell; and a half-circle palm lace run configured with two hinge points for closing the glove.

2. The glove of claim 1, wherein one of the two hinge points is at a Metacarpophalangeal (MCP) joint of the user's thumb and a second of the two hinge points is a at the Proximal Interphalangeal (PIP) joint for the fingers.

3. The glove of claim 1, wherein the glove is constructed of leather and/or synthetic materials.

4. The glove of claim 1, wherein the handstall is designed to accommodate the user's fingers, while also serving as an origin point for a thumb loop and a pinky loop.

5. The glove of claim 1, wherein a felt material is sewn onto the handstall and inserted between the inner and outer shells.

6. The glove of claim 1, wherein the handstall is separated into two portions by the half-circle palm lace run, wherein one of the portion is the thumb.

7. The glove of claim 1, wherein a half-reversed heel lace run also runs through a heel pad.

8. The glove of claim 1, wherein a heel lace is reverse-laced on a thumbside.

9. The glove of claim 1, wherein gap welting and a strategic lace pattern is at a base of the webbing.

* * * * *